US007007625B2

(12) United States Patent
Shelton

(10) Patent No.: US 7,007,625 B2
(45) Date of Patent: Mar. 7, 2006

(54) LOCATION AND MOVEMENT OF REMOTE OPERATED VEHICLES

(75) Inventor: Chris D. Shelton, London (GB)

(73) Assignee: H2EYE (International) Limited, Tortola (VG)

( * ) Notice: Subject to any disclaimer, the term of this patent is extended or adjusted under 35 U.S.C. 154(b) by 0 days.

(21) Appl. No.: 10/671,330

(22) Filed: Sep. 25, 2003

(65) Prior Publication Data

US 2005/0066871 A1 Mar. 31, 2005

(51) Int. Cl.
*B63G 8/00* (2006.01)

(52) U.S. Cl. ..... 114/312; 114/337; 440/6

(58) Field of Classification Search ..... 114/312, 114/313, 317, 337; 440/6; 340/426.17
See application file for complete search history.

(56) References Cited

U.S. PATENT DOCUMENTS 5,370,074 A * 12/1994 Knudsen et al. ..... 114/312
5,749,312 A * 5/1998 Hillenbrand et al. ..... 114/317
5,917,405 A * 6/1999 Joao ..... 340/426.17
5,995,882 A * 11/1999 Patterson et al. ..... 114/312
6,230,097 B1 * 5/2001 Dance et al. ..... 701/207
6,390,012 B1 * 5/2002 Watt et al. ..... 114/322
6,751,535 B1 * 6/2004 Mori ..... 701/213

* cited by examiner

*Primary Examiner*—Lars A. Olson
(74) *Attorney, Agent, or Firm*—Renner, Otto, Boisselle & Sklar, LLP

(57) ABSTRACT

A remote operated vehicle system comprises a topside, a fish equipped with a GPS receiver, a transmitter for transmitting GPS position data, and a receiver operable to receive the transmitted position data. Transmission may be from the fish to the topside or from the topside to the fish. Alternatively, a second transmitter and receiver give two-way transmission. These arrangements allow the position of the fish to be monitored or tracked, so that it can be readily rescued in the event of damage or breakdown. Alternatively, predetermined position data can be sent to the fish, allowing it to automatically navigate a desired route. Particular embodiments include an umbilical cable for connecting the fish and the topside together and operable to carry signals, including position data, between the two, an additional GPS receiver on the topside so that the fish can navigate to the topside unaided, and a buoyancy control device which brings the fish to the surface.

27 Claims, 13 Drawing Sheets

LOCATION AND MOVEMENT OF REMOTE OPERATED VEHICLES

BACKGROUND OF THE INVENTION

The present invention relates to location and movement of remote operated vehicles of the type for use in exploration of an underwater environment.

Remote operated vehicles (ROVs) of this type typically comprise an ROV system having a remote operated "submarine" unit or vehicle (a fish), a land- or ship-based remote control unit (a topside) and an umbilical cable for connecting the fish and the topside together and carrying signals between the fish and the topside. The fish may be powered by an onboard power unit or by a power unit located in the topside, in which case power is conveyed to the fish via the umbilical cable. The ROV system can be for commercial or leisure purposes.

The fish is usually fitted with swimming or propulsion means, such as motor driven propellers or thrusters, which are used for maneuvering the fish underwater. Also, the fish typically carries one or more video or stills cameras. Images from the cameras can be transmitted from the fish, via the umbilical cable, to the topside for displaying on a monitor or viewfinder attached to the topside. The images can be used both for observational purposes, and as visual input for a user to steer the fish along a desired path by use of controls provided on the topside. Additional devices for measuring parameters such as speed and depth can also be provided on the fish. Readings from these are also sent to the topside along the umbilical cable.

The topside is used to transmit control signals down the umbilical cable to the fish for controlling both the thrusters, and any features such as grabbers (movable arms having gripping means for picking up articles from the seabed), pan and tilt mechanisms fitted to the cameras, and lights.

ROV systems are typically costly pieces of equipment, so it is important to ensure that the fish, once deployed on an exploration trip, can be navigated accurately to avoid the risk of collision, and also safely returned to the topside after use, or recovered in some other way. This is of particular significance in situations where it is not possible for the user to drive the fish by using controls to steer the fish in response to images from the camera. This may occur if, for example, the camera is damaged or the umbilical cable is severed or damaged.

One potential way of achieving this is to provide the fish with an inertial navigation system (INS). This is an arrangement of inertial sensors in the form of gyroscopes (e.g. fiber-optic gyros) and accelerometers which continuously monitor the motion of the fish, and a processor to process the output of these devices. By successively measuring the time spent moving in a given direction at a given speed, it is possible to calculate the path travelled by the fish, and hence its position relative to its starting position (typically its launch position from the topside). Hence it can be directed to a desired location. At the end of the trip, the relative position of the fish is known. The processor can then take control of the thrusters, and drive the fish back to the topside without input from the user.

INSs are commonly used on aircraft, spacecraft and missiles to aid navigation and accurately determine position. Typically, good results are achieved. However, the systems are less well suited to the guidance of ROV system fish. The strong currents and turbulence experienced by a fish when underwater tend to contribute a large error to the INS results, making any measurements insufficiently accurate to be of use. This is particularly the case with recreational ROV systems, in which the fish is preferably small and light and hence more prone to being buffeted by underwater forces, and may also be driven in a unskilled manner. Also, the results achieved using INS depend on comparing the present calculated position with a start position. This means that the INS will only be able to correctly return a fish to its topside in situations where the topside has not moved since launch of the fish, which is not always the case. For example, the topside may be deployed from a moving boat.

An alternative approach is to use ultrasound signals to determine the position of the fish. An ultrasound signal can be emitted from the topside through water to a receiver on the fish; the time taken indicates the distance of the fish from the topside because the speed of sound in water is constant. However, while this gives a satisfactorily accurate measure of distance, it is not well-suited to determining the location of the fish. It is necessary to have a initial idea of the fish's approximate whereabouts to ensure that the ultrasound is broadcast in the correct direction. This can be improved by using further ultrasound transmitters, for example, positioned on buoys. However, this complicates the ROV system, and makes it less transportable and hence less desirable for leisure applications. Also, more complex calculations need to be performed to determine the position.

Thus it is desirable to provide an ROV system having a fish which can be accurately navigated and located.

SUMMARY OF THE INVENTION

Accordingly, a first aspect of the present invention is directed to an ROV system comprising:

a topside;

a fish fitted with a GPS receiver;

a position data transmitter operable to transmit GPS position data; and a position data receiver operable to receive GPS position data;

the position data transmitter and the position data receiver being further operable to relay GPS position data between the topside and the fish.

This configuration offers a number of advantages over the prior art methods described in the introduction. These in part arise from the fact that by using the GPS facility to measure the position of the fish, an absolute position rather than a relative position is obtained. Thus the fish can be successfully located, and recovered if necessary, regardless of any movement of the topside following launch of the fish. Use of an external reference point (the GPS satellite network) means that errors such as those to which an INS is prone are avoided, because the measured position of the fish does not depend on its previous movements. Also, GPS receivers are compact and robust, particularly compared with an INS, and can readily be incorporated into a fish without the need for complex engineering considerations. Compared with an ultrasound system, accurate positioning can be achieved without the need for a dedicated network of transmitters and receivers.

Transmission of GPS data between the topside and the fish further increases the functionality of providing a fish with a GPS receiver. Transmission can be arranged to be one-way, in either direction, or two-way. Embodiments of the invention are directed to various arrangements.

In one embodiment, the fish includes the position data transmitter, the position data transmitter being operable to transmit GPS position data obtained from the GPS receiver;

and the topside includes the position data receiver, the position data receiver being operable to receive the GPS position data transmitted from the fish.

Thus, the measured position of a fish can be communicated to the user located at the topside. Position data derived from a GPS receiver is particularly well-suited for this purpose as it is directly obtained in a useful and meaningful format within a defined co-ordinate system, which can be readily utilised by the user to locate the fish. In contrast, the relative positions obtained by INS and ultrasound are less meaningful simply because they are relative, and in most cases the output of these measurement systems requires complex processing before it can be reported to the user in any useful format.

In a further embodiment, the topside is fitted with a GPS receiver, and includes the position data transmitter, the position data transmitter being operable to transmit GPS position data obtained from the topside GPS receiver; and the fish includes the position data receiver, the position data receiver being operable to receive GPS position data transmitted from the topside.

In contrast to the previous embodiment, the communication of position data is from the topside to the fish. This arrangement allows the fish to measure its own position using the GPS receiver, and also receive data indicating the position of the topside. Using this, the fish is able to automatically navigate back to the topside in response to a command or an emergency by determination of the relative position of the fish to the topside. Thus, all processing of the data is confined to the fish, which is beneficial in instances such as severance or detachment of an umbilical cord connecting the fish and the topside.

In a yet further embodiment, the topside includes the position data transmitter, the position data transmitter being operable to transmit predetermined GPS position data; and the fish includes the position data receiver, the position data receiver being operable to receive predetermined GPS position data from the topside.

Again, communication of the position data is from the topside to the fish. In this case, though, the fish receives predetermined position data. This can represent a specific route to be navigated by the fish, and be supplied to the topside by a user. Once the fish has received this information, it can automatically navigate the route by comparing the predetermined position data with periodic measurements of its own position, obtained from the GPS receiver. This allows the fish to automatically collect data of interest, such as video data, without the need for the user to steer the fish along the desired route. Thus, no ROV driving skills are required.

In a preferred embodiment, the fish has an onboard power supply. This gives a more versatile ROV system. If the fish carries its own power supply, it will be able to propel itself and perform processing functions without the need for a physical connection to the topside, such as a cable. In the event of damage so such a cable, the fish can still operate, possibly to a limited extent. Therefore, in an emergency, or following deliberate detachment of a cable, the fish can make direct use of the position data obtained from its GPS receiver and travel, possibly automatically, to the topside or an alternative destination. Moreover, an onboard power supply permits a thinner and lighter cable to be used, because the cable does not need to carry power to the fish. This in itself can help to avoid the occurrence of emergencies, because the cable is less likely to become entangled and additionally makes the ROV system as whole lighter and more compact and hence well-suited for leisure use.

Advantageously, the fish comprises an upwardly protruding portion which houses the GPS receiver aerial. The operation of GPS is affected by water, so the fish needs to be at the surface for the GPS receiver to be utilised. By mounting the aerial above the level of the main body of the fish, it will generally be in a usable position no matter at what level the fish is floating at the surface. A dedicated upwardly protruding portion can be provided for the aerial, but in some embodiments it is conveniently placed in or on an alternative portion, such as a periscope provided for carrying a camera.

In one embodiment, the ROV system further comprises an umbilical cable for interconnecting the fish and the topside, and having a communication path for relaying the position data. In an alternative embodiment, the position data is transmitted via air. The former arrangement allows for the efficient transmission of data along a dedicated medium, whereas the latter arrangement allows data to be transmitted in situations where an umbilical cable is not used, or had been put out of use for some reason. Also, transmission by air allows autonomous use of the fish without an umbilical cord, such as outside the range permitted by the length of the umbilical cord, or where the umbilical cord is likely to become entangled, such as during exploration of a wreck. Preferably, the ROV system is configured for transmission by either method so that the method most appropriate to the circumstances can be used.

In a preferred embodiment, the umbilical cable comprises a connector operable to detachably connect it to the fish, and which can be remotely operated by a detach command sent from the topside which causes the cable to detach from the fish. In use, the cable may become entangled or snagged, and be in danger of breaking. To avoid this, the cable can be remotely detached by a user. The GPS receiver on the fish facilitates recovery of the fish once the physical connection between the fish and the topside is lost. Alternatively, the user may wish to detach the umbilical cable after deployment of the fish, for example, if the fish is to be sent beyond the length of the cable while following a pre-set route.

The ROV system may further comprising a tension sensor operable to measure tension in the umbilical cord and to cause a detach command to be sent to the connector if the tension exceeds a predetermined level. This provides automatic detachment of the umbilical cable, which may prevent damage in the event that the user does not realise that the cable is under tension and at risk of severance.

Advantageously, the topside further comprises a GPS receiver. This provides additional valuable position data by which the fish can be recovered or further navigated, either automatically or by the user. The relative position of the fish to the topside can be determined so that the fish can be readily returned to the topside in an emergency or at the end of a trip.

Additionally, the topside may further comprise a second position data transmitter operable to transmit GPS position data obtained from the GPS receiver on the topside from the topside to the fish, and the fish further comprises a second position data receiver operable to receive position data transmitted from the topside. This gives two-way communication of position data between the fish and the topside, and therefore allows a processor on the fish to perform any data processing involving the position of the topside which is needed to navigate the fish. This is of particular use in cases where an umbilical cable is used but becomes severed or detached from the fish. Also, use with no umbilical cord is possible.

In some embodiments, the ROV system further comprises a movement control device operable to process position data and control movement of the fish in response to results of the processing. This can involve processing such as determining the relative position of the fish and the topside so that the fish can be returned to the topside, or making calculations based on provided, predetermined, position data so that the fish can travel to a desired location. The movement control device may be located in the fish, or in the topside. The former arrangement allows the fish to operate if communication with the topside via an umbilical cable is lost or if use of an umbilical cable is not desirable, whereas the latter makes for a simpler fish.

The movement control device may be operable to process GPS position data obtained from the GPS receiver on the fish during earlier movements and control subsequent movement of the fish in response to results of the processing. This permits use of the known GPS feature called "backtracking", in which measurements made by the GPS receiver are logged so as to permit a route to be retraced.

The topside may comprise a GPS position data input device for user input of predetermined GPS position data. The ROV system may further comprise a movement control device operable to process the predetermined GPS position data and GPS position data obtained from the GPS receiver, and control movement of the fish in response to results of the processing. Using this arrangement, the user can enter the GPS reading for a desired location and the fish can travel to it automatically. A plurality of locations making up a route can also be entered, so that the fish can navigate a particular environment without further user intervention. Additionally, the position of the topside can be provided and used to navigate the fish back to the topside.

Advantageously, the fish further comprises a buoyancy control device operable to automatically surface the fish from a depth of water in response to one or more predetermined conditions. The predetermined conditions may include one or more of: severance of an umbilical cable; detachment of an umbilical cable from the fish; failure of a power supply operable to power the fish; and failure of thrusters operable to propel the fish. These may be regarded as "emergency" situations in which it is desirable to bring the fish to the surface quickly and automatically to avoid further damage or outright loss. Once on the surface, the GPS receiver facilitates recovery of the fish.

In one embodiment, the fish includes the position data transmitter, and the buoyancy control device is further operable to activate the GPS receiver and the position data transmitter when the fish surfaces. Thus, the fish automatically broadcasts its position, which is beneficial in situations where the umbilical cable is used for communication but is rendered unusable so that the topside cannot interrogate the fish to determine its location. Furthermore, the fish may further comprise a movement control device operable to process GPS position data obtained from the activated GPS receiver and control movement of the fish in response to the results of the processing so as to propel the fish toward the topside. Thus the fish is automatically returned to the topside without the need for user intervention. This is aided in an embodiment wherein the movement control device is further operable to process position data received from a GPS receiver on the topside, thus allowing the fish to calculate its position relative to the topside.

Additionally, the ROV system may further comprise an inertial navigation system on the fish operable to monitor movement of the fish and calculate its position relative to a starting position. An INS can be used to steer the fish underwater, but these systems are prone to error in a submarine environment. However, by surfacing from time to time, the GPS receiver can make an accurate absolute measurement of the fish's position, which can be used to correct the INS. Thus, the combination of GPS and INS permits accurate navigation both below and on the water surface.

A second aspect of the present invention is directed to a method of recovering a fish associated with an ROV system, comprising:

surfacing the fish from a depth of water;

activating a GPS receiver on the fish to obtain first position data relating to the absolute position of the fish;

activating a GPS receiver on a topside to obtain second position data relating to the absolute position of the topside;

comparing the first and second position data to determine the relative position of the fish and the topside;

providing third position data relating to the relative position to a movement control device operable to control propulsion of the fish; and controlling propulsion of the fish in response to the third position data to bring the fish adjacent to the topside.

In a preferred embodiment, the fish is automatically surfaced from a depth of water in response to severance or detachment of an umbilical cable interconnecting the fish and the topside.

The comparison of the first and second position data may comprise sending position data between the fish and the topside by radio frequency communication. This is advantageous in that the data can be exchanged directly by a wireless connection in the event that any umbilical cable used to connect the fish and the topside subsequently cannot be used for data transmission. Alternatively, it permits autonomous navigation of the fish without any umbilical cable.

A third aspect of the present invention is directed to a method of navigating a fish associated with an ROV system, comprising:

determining a route along which the fish will navigate;

determining a plurality of GPS position data, each datum corresponding to a location on the route;

providing the GPS position data to a topside of the ROV system;

transmitting the GPS position data from the topside to the fish; and activating a movement control device on the fish operable to propel the fish from location to location in response to the GPS position data and periodic measurements of actual fish location obtained from a GPS receiver on the fish.

This method provides for autonomous navigation of the fish, without the need for continuous user input to steer the fish.

A fourth aspect of the present invention is directed to a method of navigating a fish associated with an ROV system, comprising:

providing the fish with an inertial navigation system and a GPS receiver;

propelling the fish underwater from a starting position;

monitoring movement of the fish with the inertial navigation system to calculate its position relative to the starting position;

periodically surfacing the fish and activating the GPS receiver to obtain a measurement of absolute position of the fish;

comparing the measured absolute position and the calculated relative position to determine any error in the calculated relative position; and correcting the calculated relative position to correspond to the measured absolute position if an error is found.

BRIEF DESCRIPTION OF THE DRAWINGS

For a better understanding of the invention and to show how the same may be carried into effect reference is now made by way of example to the accompanying drawings in which:

FIG. 2(*a*) shows a cross-sectional view through the fish of FIG. 2;

DETAILED DESCRIPTION

Structure of the ROV System

Figure 1:
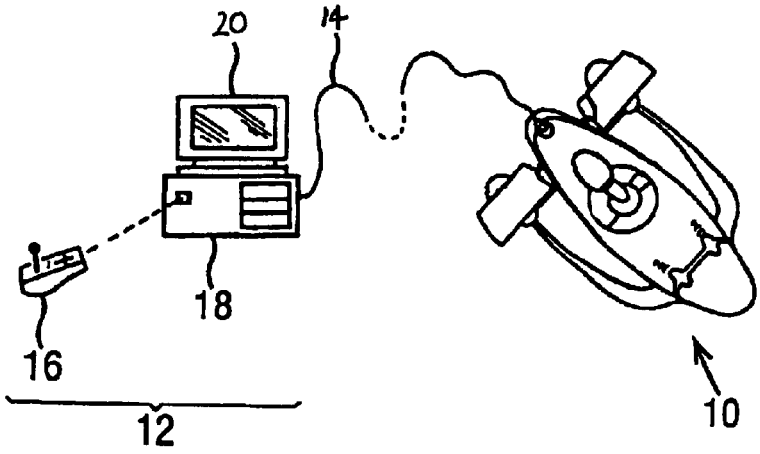
FIG. 1 shows a schematic view of an ROV system according to the present invention and comprising a topside and a fish connected by an umbilical cable.

FIG. 1 shows a schematic perspective view of a remote operated vehicle (ROV) system in accordance with the present invention. The ROV system is a collection of units which together perform the function of an underwater remotely controlled television camera. The ROV system comprises two main units, these being the underwater unit or "fish" 10, and the surface control unit or "topside" 12. Joining the two main units is a cable or "umbilical cable" 14. The umbilical cable is preferably at least 200 m long and accordingly is, for ease of handling, generally wound onto a winder, not shown.

The topside 12 comprises a wireless handset 16 and a computer unit 18. A user can enter controls for the fish into the handset 16 via various buttons, and the handset 16 transmits corresponding signals to the computer unit 18. During the deployment activities of the fish 10, there are different activities such as launch, depth deployment and recovery of the fish 10 from the water. For these different operations, the operator may need to be in a different place or may need to move about the area in which the operations take place. The wireless handset makes this easy and safe as the operator is free to move anywhere within the range of the wireless link. The wireless communication is in air so can include radio, EM induction, ultrasonic or optical signals. Radio frequency transmissions are preferred. Alternatively or additionally, control buttons can be provided directly on the computer unit 18, so that the handset 16 is not needed.

The computer unit 18 contains a receiver which receives signals from the handset 16. These signals are processed prior to conveying corresponding instructions to control components on the fish 10 via the cable 14. A monitor 20 is provided for the computer unit 18, which displays images captured by one or more cameras mounted on the fish 10.

Figure 2:
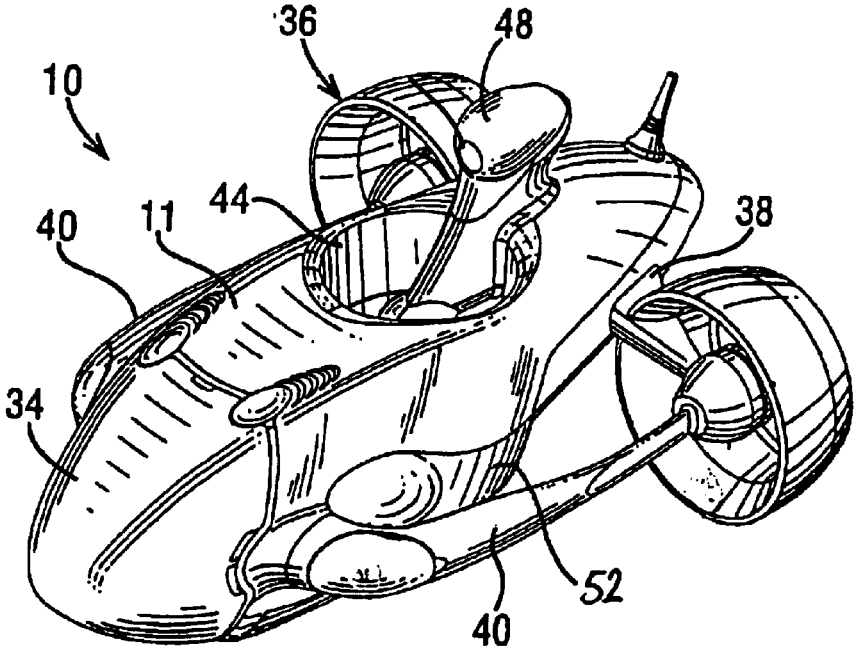
FIG. 2 shows a perspective view of the fish of FIG. 1.
Figure 2:
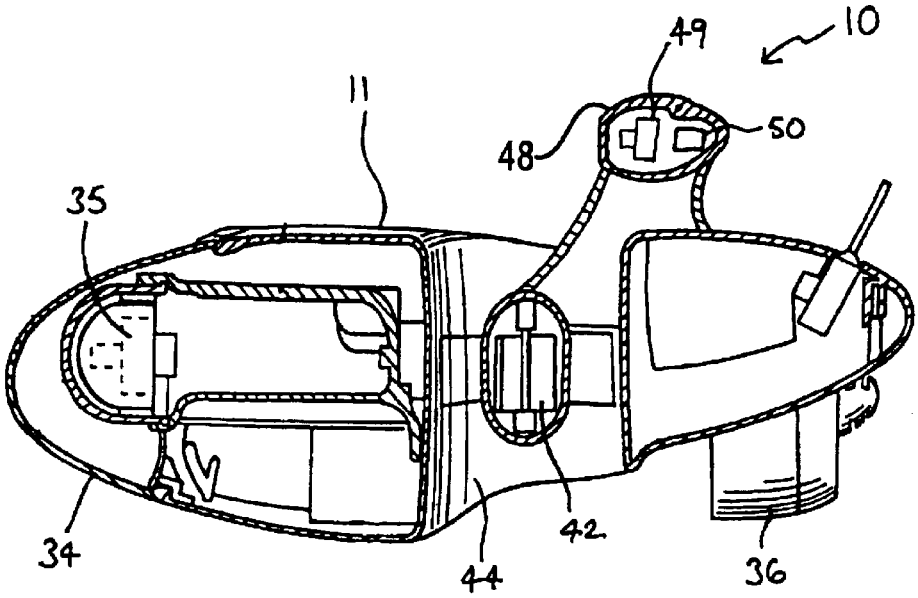

FIG. 2 shows a more detailed perspective view of the fish 10. The fish 10 shown is only a preferred embodiment; the fish may be any desired shape or size and carry any variety of cameras and sensors without departing from the scope of the present invention.

The fish 10 comprises a main body 11 which contains a pressure vessel housing a processing unit for controlling components of the fish 10. At the front end of the fish 10 is a transparent dome 34 in which is mounted a video camera. A second camera is provided within a periscope portion 48 extending upwards from a rearward portion of the main body 11. This camera enables a view from above the water surface to be seen when the fish 10 is at the water surface, and provides a second underwater view when the fish 10 is submerged. The pressure vessel may also house one or more image storage media for storing image data obtained from the cameras, and from which the image data can be retrieved when the fish returns to the surface. Any suitable media may be used, such as a hard disk, a tape, or solid state memory.

A pair of thrusters 36 are provided towards the rear end of the fish 10, mounted one on each side of the main body 11 via two arms 38, 40. The thrusters 36 are independently drivable to allow forward, reverse and rotational propulsion force to be given to the fish 10. A third thruster (not shown in FIG. 2) is provided in the main body 11 of the fish 10 within a vent 44 extending through the main body 11. The third thruster 42 provides a vertical driving force to raise or lower the fish 10 within water.

The fish 10 is powered by an onboard power supply 52, in the form of a battery which is removably mounted on the bottom of the main body 11. Alternatively, in some embodiments of the invention power may be derived from a power supply on the topside 12, and fed to the fish 10 down the umbilical cable 14. However, an onboard power supply is advantageous in several respects. To send sufficient power along the umbilical cable 14, it is necessary to either use a thick heavy cable, which hampers movement of the fish, or high voltages, which are unsafe. Also, providing the fish 10 with an onboard power supply 52 allows it to continue to function in the event that the umbilical cable 14 is damaged or severed. The power is used to propel the fish 10 by its thrusters 36, to operate the cameras and any other sensors the fish 10 has, to operate underwater lights provided on the fish 10, and to operate an onboard processor by which the fish 10 can be controlled.

The umbilical cable 14 is used to send data between the topside 12 and the fish 10. The data may include video images sent from the fish's cameras to be viewed on the monitor 20 of the topside 12. The cable also allows the fish 10 to be commanded from the topside 12 by a user, and permits the fish 10 to send information regarding its status to the topside 12. The umbilical cable 14 carries data between the fish's processor and the computer unit 18 at the topside 12. Any suitable cable can be used, including optical fiber or coaxial cable.

FIG. 2(*a*) is vertical cross-section through the fish shown in FIG. 2. This shows the video camera 35 housed in the transparent dome 34, and the second camera 49 housed in the periscope portion 48. Also visible in this view is the vertical thruster 42 mounted within the vent 44.

The umbilical cable 14 is detachably coupled to the fish 10. This is convenient for transporting the ROV system, but also provides advantages when the fish is swimming. By providing a suitable mechanical connector to couple the cable 14 to the fish 10, the cable 14 can be remotely detached from the fish 10 if a suitable command signal to activate the connector mechanism is sent from the topside 12. This is useful if the cable 14 becomes entangled during use and appears likely to break or be otherwise damaged. The user can send the command signal, for example, by way of a button provided on the handset. Additionally or alternatively, a tension sensor can be provided to monitor tension in the umbilical cable 14 and automatically trigger the sending of a detachment command if the tension exceeds a predetermined level. The provision of an onboard power supply 52 and processor for the fish 10 allows it to continue to function, possibly to a limited extent, without the umbilical cable 14. This may be facilitated by the provision of on-board sensors which allow the fish to determine factors relating to its environment, such as pressure and temperature sensors. Detachment of the cable 14 can be arranged to cause the processor to execute a standard recovery procedure.

More details of the structure, function and operation of the ROV system are beyond the scope of the present application, but can be found in co-pending patent applications U.S. Ser. No. 09/928,258 or WO-A-01/58751. Moreover, the present invention is not limited to the ROV system illustrated herein or therein, and may be applied to any underwater ROV system comprising a fish and a topside.

First Embodiment

According to a first embodiment of the present invention, the ROV system described above is provided with a global positioning system (GPS) receiver mounted on or in the fish 10. By using the receiver to interrogate the GPS satellites orbiting the earth, the fish 10 is able to determine its absolute position in the known manner of using GPS. As is well-known, a typical GPS receiver does not operate accurately underwater. Thus, the GPS receiver can be used to determine the position of the fish 10 when it is on the surface of a body of water. To facilitate this, the GPS receiver is preferably mounted on the top surface of the fish 10 to ensure that it is above the water level as the fish floats on, or moves along, the surface. In the illustrated embodiment, this may conveniently be achieved by mounting the GPS receiver 50 in the periscope portion 48 of the fish 10 (see FIG. 2(*a*)). Alternatively, the fish 10 may be provided with any upwardly protruding portion extending from the main body 11, on which the GPS receiver aerial can be mounted or in which it can be housed. The GPS receiver should be provided with a water-tight housing able to withstand the water pressure at the depths at which the fish is intended to be used. The GPS receiver (and one or more of its associated components) may be provided integrally within the fish 10, or alternatively as a removable module. This latter option allows for more convenient repair, replacement or upgrade of the GPS receiver, and also allows the ROV system to be optionally supplied without GPS capabilities.

The fish 10 is also provided with a transmitter operable to transmit to the topside 12 data representing the position or location of the fish as determined by the GPS receiver (position data). The topside 12 is provided with a corresponding receiver to receive the position data. The position data can then be displayed to the user, via the monitor 20 or other means such an LCD screen on the handset 16. The position data may be processed by the computer unit 18 for the purpose of sending commands to the fish, or the user can use the information directly to locate and retrieve the fish, for example by the use of maps. The GPS unit can be activated at the option of the user by sending a command signal along the umbilical cable 14. Alternatively or additionally, the fish 10 can be provided with an automatic activating device which triggers the GPS receiver to take a reading whenever the fish 10 surfaces from a depth of water, or periodically for as long as the fish 10 is on the surface. This will enable the topside 12 to keep track of the fish 10 if it is floating freely without being driven.

The position data can be sent via any suitable signal carrier. Radio frequency transmissions are to be preferred.

Figure 3:
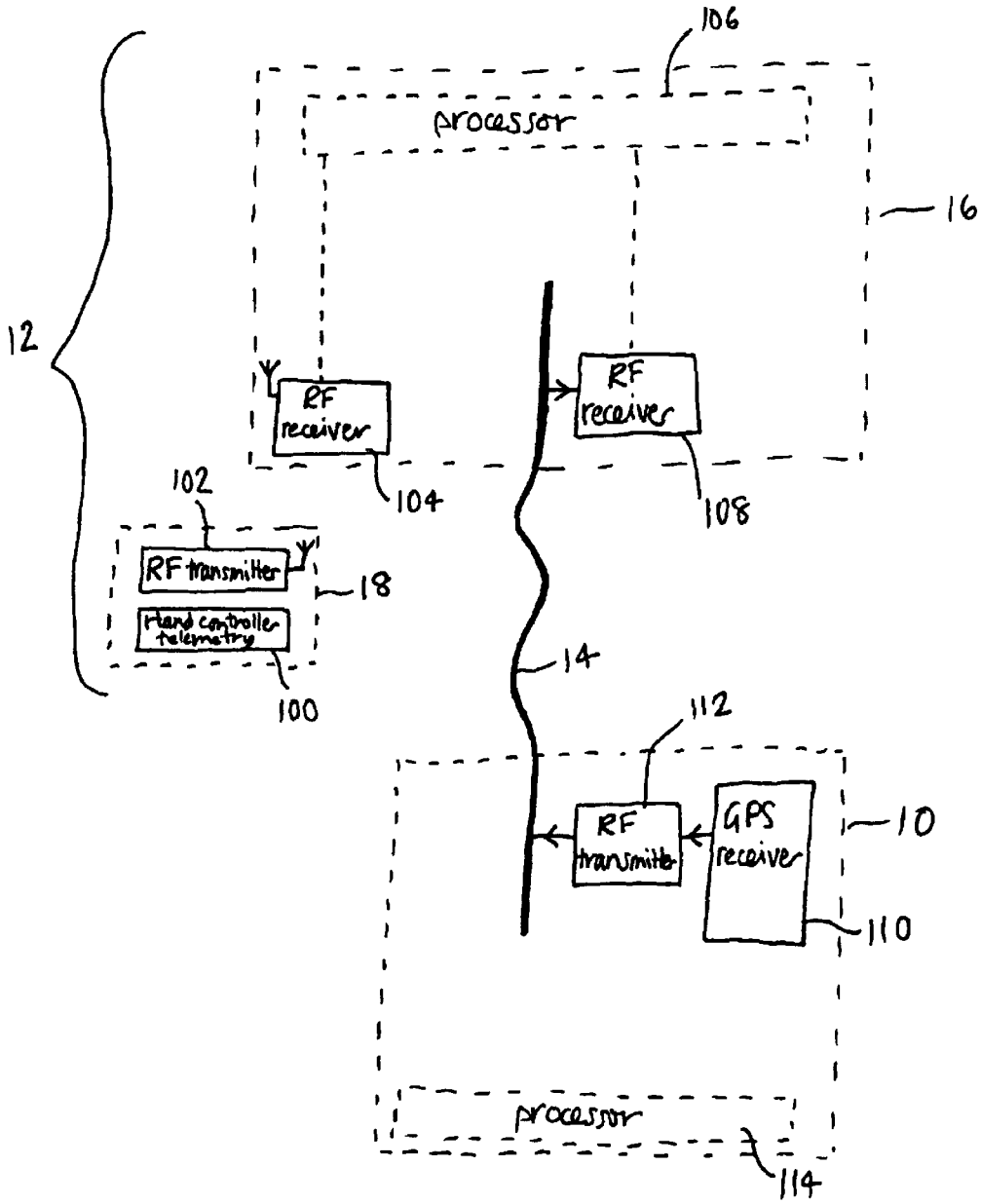
FIG. 3 shows a block diagram of electronic components comprised within a first embodiment of the present invention.

FIG. 3 shows a block diagram of various electronic components of the topside 12 and the fish 10 used to implement the present embodiment. The topside 12 comprises a handset 18 and a computer unit 16. The handset 18 comprises a hand controller telemetry unit 100 for receiving commands input to the handset 18 by the user. These commands are relayed to the computer unit 16 by a radio frequency (RF) transmitter 102. A wireless link is used, although alternatively, a cable link can be used.

The computer unit 16 includes a first RF receiver 104 which receives commands sent from the handset 18. These commands are forwarded to a processor 106 which controls general operation of the fish. Most functions of the processor 106 are unrelated to the use of GPS according to the present invention, so will not be described herein. The reader is referred to U.S. Ser. No. 09/928,258 or WO-A-01/58751 for further information. The computer unit 16 also comprises a further RF receiver 108 which receives position data sent along the umbilical cable 14 as RF signals by the fish 10.

The fish 10 carries a GPS receiver 110 which outputs position data relating to the absolute position of the fish 10. The position data is sent to an RF transmitter 112 in the fish 10 which transmits the data as an RF signal along the umbilical cable 14 to the corresponding RF receiver 108 in the computer unit 18. The fish 10 also comprises a processor 114, most functions of which, as with the topside processor 106, are unrelated to the use of GPS. Once received at the topside 12, the position data is sent to the topside processor 106 for display and/or processing as described above. Also, this configuration allows a log to be kept of the fish's movements during a trip, if GPS measurements are periodically made and recorded by the fish processor and/or the topside processor. Such a log can be used to replicate the trip on subsequent occasions, if desired. This can be done without an umbilical cord, if desired, by ensuring that the log is provided to the fish processor before the trip begins.

Second Embodiment

The embodiment of FIG. 3 is a configuration in which the position data is sent along the umbilical cable. However, this is not possible in the event of the cable 14 breaking, or deliberately being detached by the user, or not being used from the outset.

Figure 4:
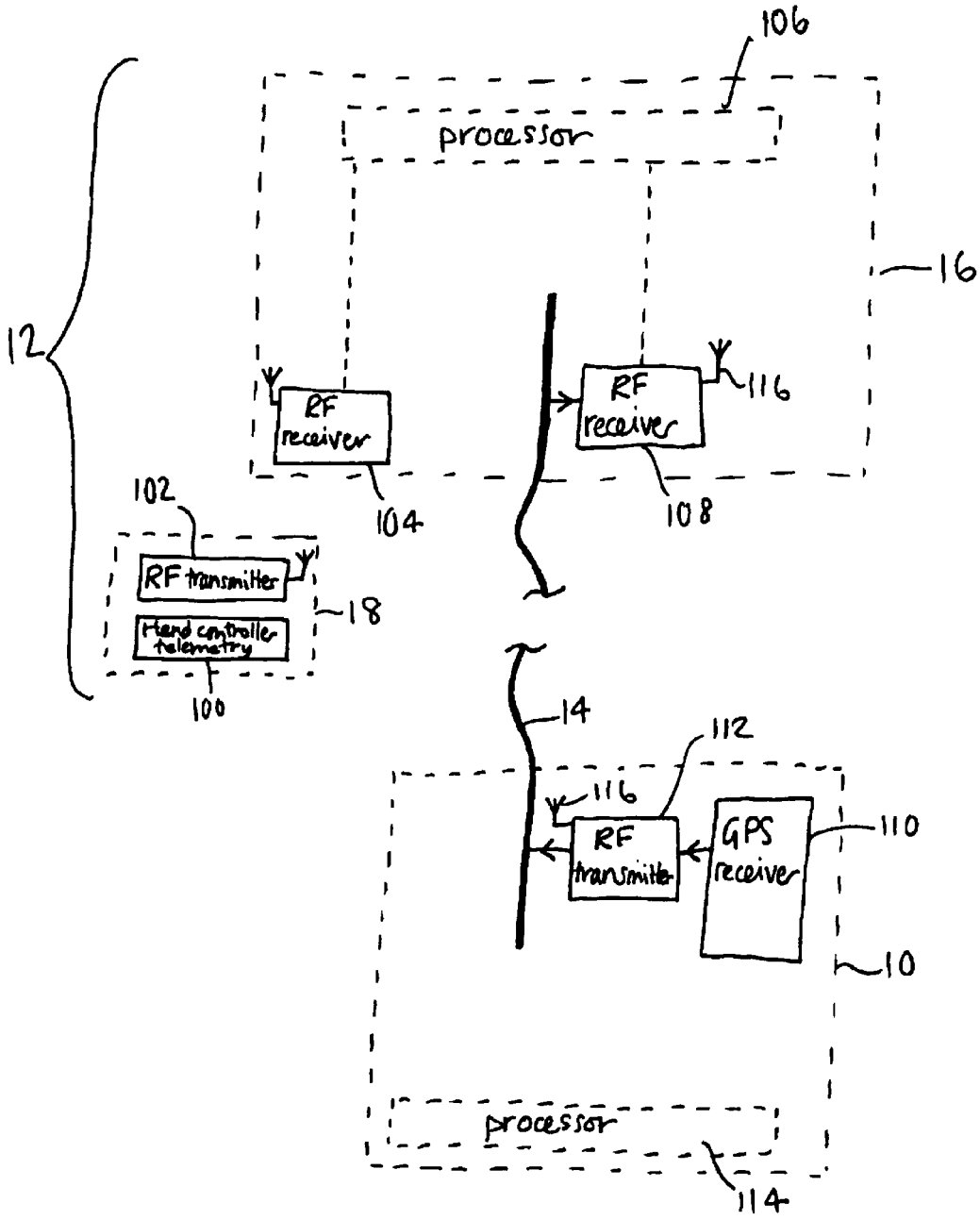
FIG. 4 shows a block diagram of electronic components comprised within a second embodiment of the present invention.

FIG. 4 shows an alternative embodiment in which the RF transmitter 112 in the fish 10 broadcasts to the RF receiver 108 in the topside 12 by a wireless link through air. Both transmitter 112 and receiver 108 are hence equipped with aerials 116. This wireless link allows the fish 10 to send position data to the topside 12 without using the umbilical cable 14, so that data can be communicated if the cable 14 is broken, as shown in FIG. 4. To ensure clear communication the RF transmitter 116 is preferably located on an upwardly protruding part of the fish 10, for example the periscope portion 48 shown in FIG. 2.

Although FIGS. 3 and 4 present the sending of the position data via the umbilical cord 14 or via a wireless link as being alternatives, in a preferred embodiment both options are provided. The fish RF transmitter 112 is configured to communicate via the umbilical cable 14 whenever possible, and via the wireless link otherwise; this ensures that the signal quality is the best achievable under the circumstances.

Third Embodiment

Guidance of the fish can be further improved by providing a second GPS receiver in the topside.

Figure 5:
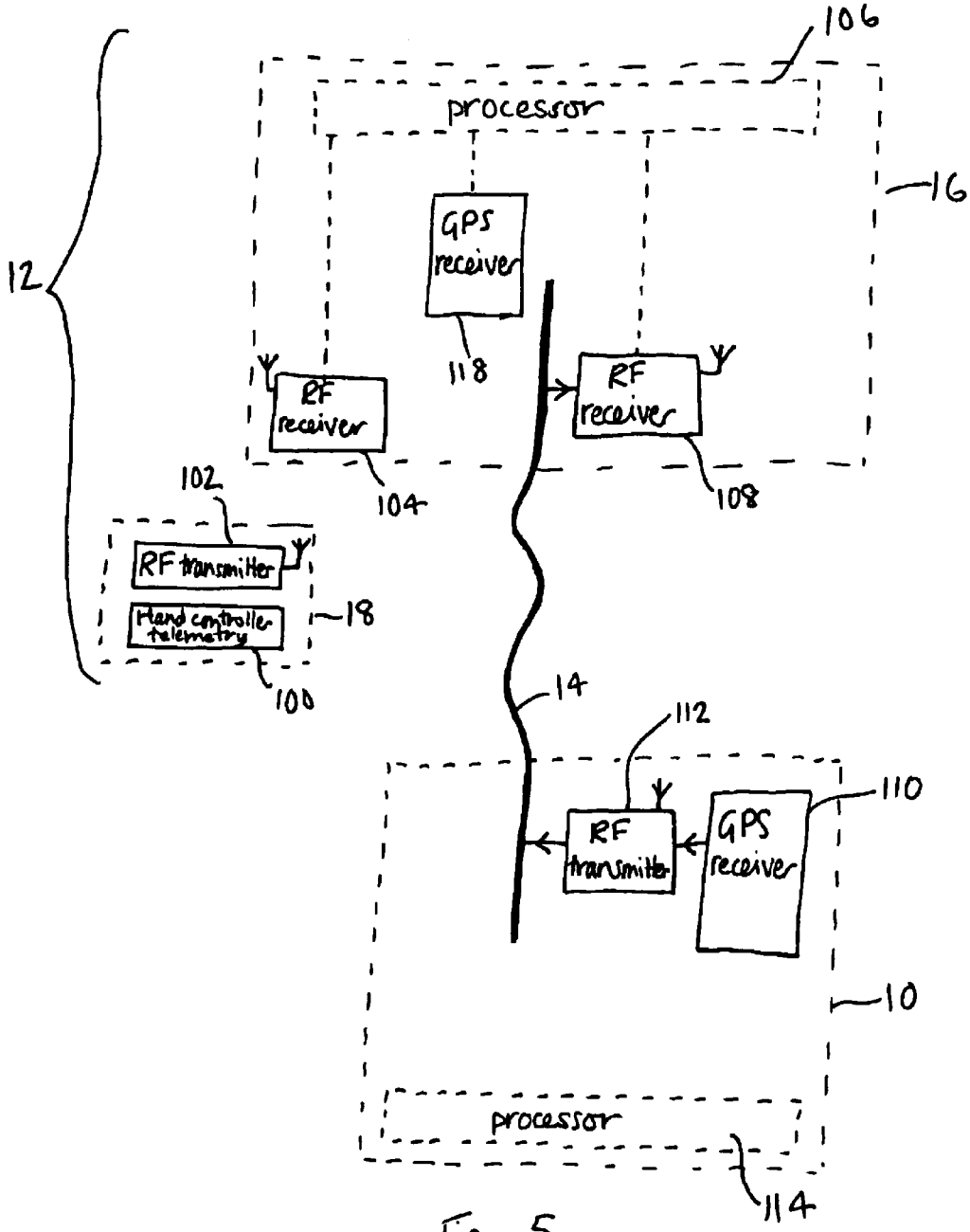
FIG. 5 shows a block diagram of electronic components comprised within a third embodiment of the present invention.

FIG. 5 shows a block diagram of this embodiment. The same components are depicted as those in FIGS. 3 and 4, with the addition of a GPS receiver 118 in the topside computer unit 16, which is in communication with the processor 106 of the computer unit 18. Alternatively, the GPS receiver 118 can be mounted elsewhere on or in the topside, with a data link to the topside processor 106.

This embodiment allows the topside 12 to measure its absolute position by using its GPS receiver 118. The resulting measurement is supplied as position data to the topside processor 106, where it can be compared with position data supplied by the fish 10. By comparing the position data from the two units, the processor 106 can determine their relative position. The comparison may be conducted by any suitable method, such as the use of an appropriate piece of software, or by a comparator circuit. The relative position can then be used by the topside processor 106 to determine how to drive the fish 10 back to the topside 12, by sending movement commands along the umbilical cable 14 to the fish processor 114 or directly to the thrusters 36. Thus, at the end of a trip, the fish can be automatically returned to the topside without user intervention. The topside processor can be configured with suitable software to allow this to happen in response to a single command from the user, input via the handset 18. The command may, for example, initiate a return sequence comprising the steps of bringing the fish to the surface, obtaining a fish GPS reading (first position data) and transmitting it to the topside, obtaining a topside GPS reading (second position data), comparing the two readings, and using the result of the comparison (third position data) to send movement commands from the topside to the fish which drive the fish to the topside.

Fourth Embodiment

The previous embodiment relies on the relative position being determined by the topside 12, and subsequent commands being sent from the topside 12 to the fish 10. However, this relies on the umbilical cable 14 being in use, for the commands to be transmitted to the fish 10.

A fourth embodiment overcomes this by providing for two-way communication of GPS position data between the fish 10 and the topside 12. In this way, the fish 10 can receive position data relating to the absolute position of the topside 12, allowing calculation of the relative position to be performed by the fish processor 114, which then itself drives the fish 10 back to the topside 12 by controlling the thrusters 36 in accordance with the result of the calculation.

Figure 6:
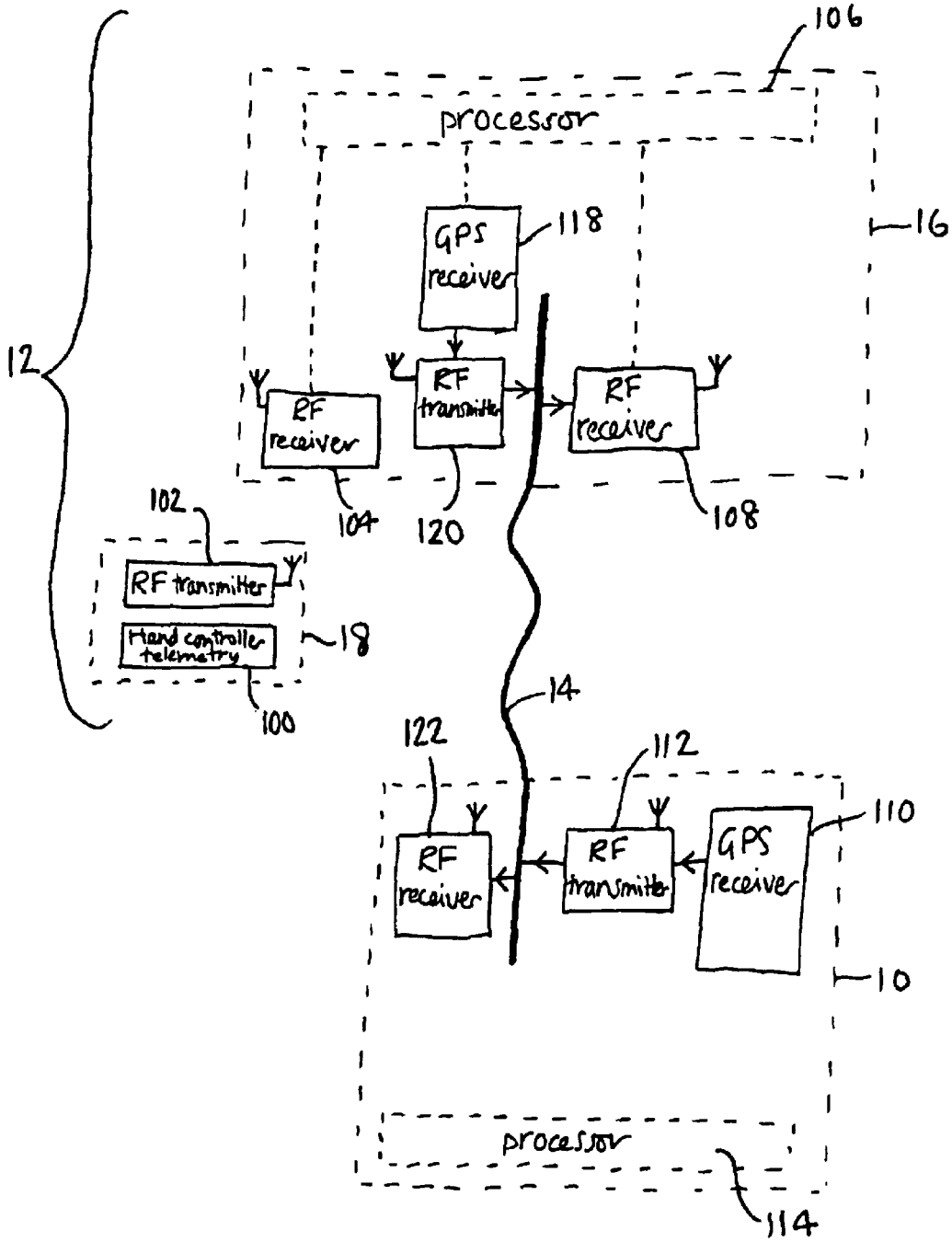
FIG. 6 shows a block diagram of electronic components comprised within a fourth embodiment of the present invention.

FIG. 6 shows a block diagram of the electronic components present in this embodiment. The components correspond to those shown in FIG. 5, and further include an RF transmitter 120 in the topside 12 adapted to receive position data from the topside GPS receiver 118 and transmit the data to a corresponding RF receiver 122 in the fish 10. As in the case of the transmitter 112 and receiver 108 arranged to convey position data from the fish 10 to the topside 12, this second transmitter/receiver pair can communicate via the umbilical cable 14 or via a wireless link through air. This allows the fish 10 to be recovered if the umbilical cable 14 is severed or detached from the fish 10 so that commands can no longer be sent from the topside processor 106 to the fish processor 114. Upon detachment or severance of the cable 14, the topside GPS receiver 118 can be arranged to automatically take a measurement of the topside position and transmit it to the fish 10 via the wireless link. The fish 10 can then measure its own position using its GPS receiver 110, calculate the relative position, and drive back to the topside. This is of particular use if the topside 12 is situated onboard a boat or other vessel, so that its absolute position can vary and will probably differ from that which it had when the fish 10 was launched. Under these conditions, the fish 10 can only determine the topside's location if it receives a transmission of recently measured position data from the topside 12.

Fifth Embodiment

Several of the preceding embodiments have discussed the use of drive or movement commands to cause the fish 10 to return to the topside 12. These commands may be generated by either of the processors 106, 114, or by one or more dedicated devices which may deal only with GPS-derived position data and produce movement commands accordingly. In either case, for the sake of simplicity, the processing of position data and the resulting control of movement of the fish 10 can be considered to be undertaken by a movement control device, which may or may not form part of the fish processor, but may be in communication with it. If not, the movement control device needs to be able to directly control the thrusters 36. The movement control device can be incorporated with or without various of the features discussed thus far.

Figure 7:
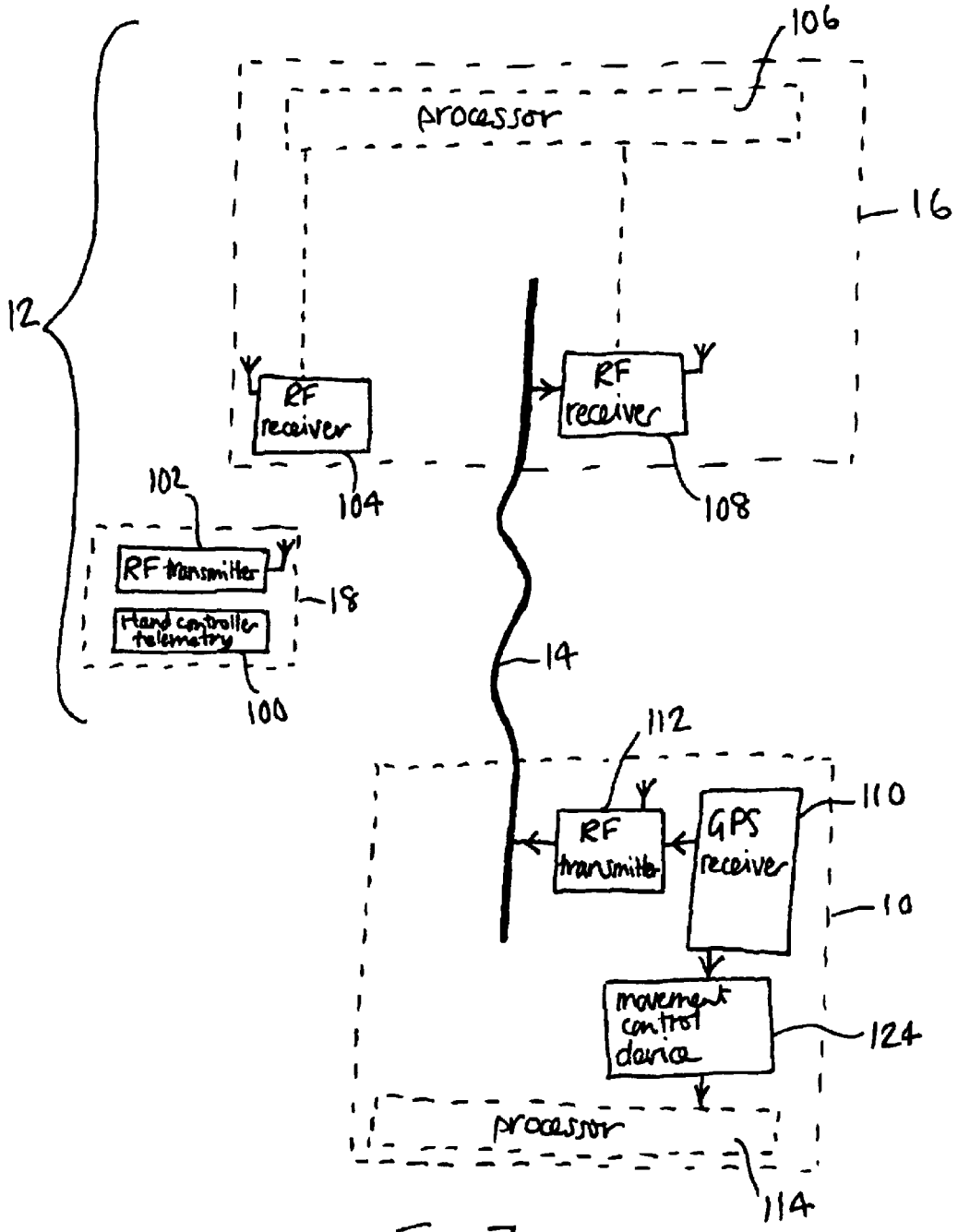
FIG. 7 shows a block diagram of electronic components comprised within a first aspect of a fifth embodiment of the present invention.

FIG. 7 shows a GPS-equipped ROV system having the components discussed with respect to FIGS. 3 and 4, so that the fish 10 can measure its position by GPS and transmit position data to the topside 12. In addition, in this embodiment, a movement control device 124 is provided in the fish 10, which receives position data from the fish GPS receiver 110. This arrangement allows the topside 12 to monitor the position of the fish 10, but also allows the fish 10 to control its own movements in response to the GPS measurements. A possible application of this is to allow the fish to automatically return to the topside after a trip in the case of the topside being stationary throughout, whether or not the umbilical cable is in use. The position of the topside 12 is stored in the fish 10 before the trip begins, and at the end the fish can use this information to calculate its relative position and how to return.

Also, the configuration may be used to provide a simple way of sending the fish 10 to a desired location, for example, a known ship wreck. A GPS reading for the location can be fed to the movement control device 124 before the trip begins. Once the fish 10 is in the water, its position can be measured so that the movement control device 124 can calculate the position of the fish 10 relative to the location, and direct the fish 10 accordingly. In a more detailed embodiment, a plurality of GPS readings can be provided, representing a route for the fish to navigate. This predetermined position data can be entered into the topside processor 106, for example via the handset 18, and transmitted to the fish 10 via the RF connection between the topside RF transmitter 120 and the fish RF receiver 112.

Advance provision of directions in this manner allows the fish 10 to be operated without an umbilical cord, because there is no necessary data which needs to be exchanged between the fish 10 and the topside 12 during use. Any images recorded by the cameras can be stored in the image storage media on the fish 10, and retrieved later, rather than being continuously transmitted to the topside 12 along an umbilical cable 14. This is of particular benefit if the fish 10 is to traverse a known but circuitous route, in which the umbilical cable 14 is likely to become entangled. Also, the fish 10 can be sent to remote locations beyond the range determined by the length of the available umbilical cable 14. No fish driving skills are required on the part of the user, either. In this embodiment, two-way communication between the fish 10 and the topside 12 is not needed. Hence, the topside need not have a RF receiver, and the fish need not have a RF transmitter, although these features will facilitate retrieval of the fish in accordance with the previously described embodiments, in the event that it is unable to return to the topside.

Figure 8:
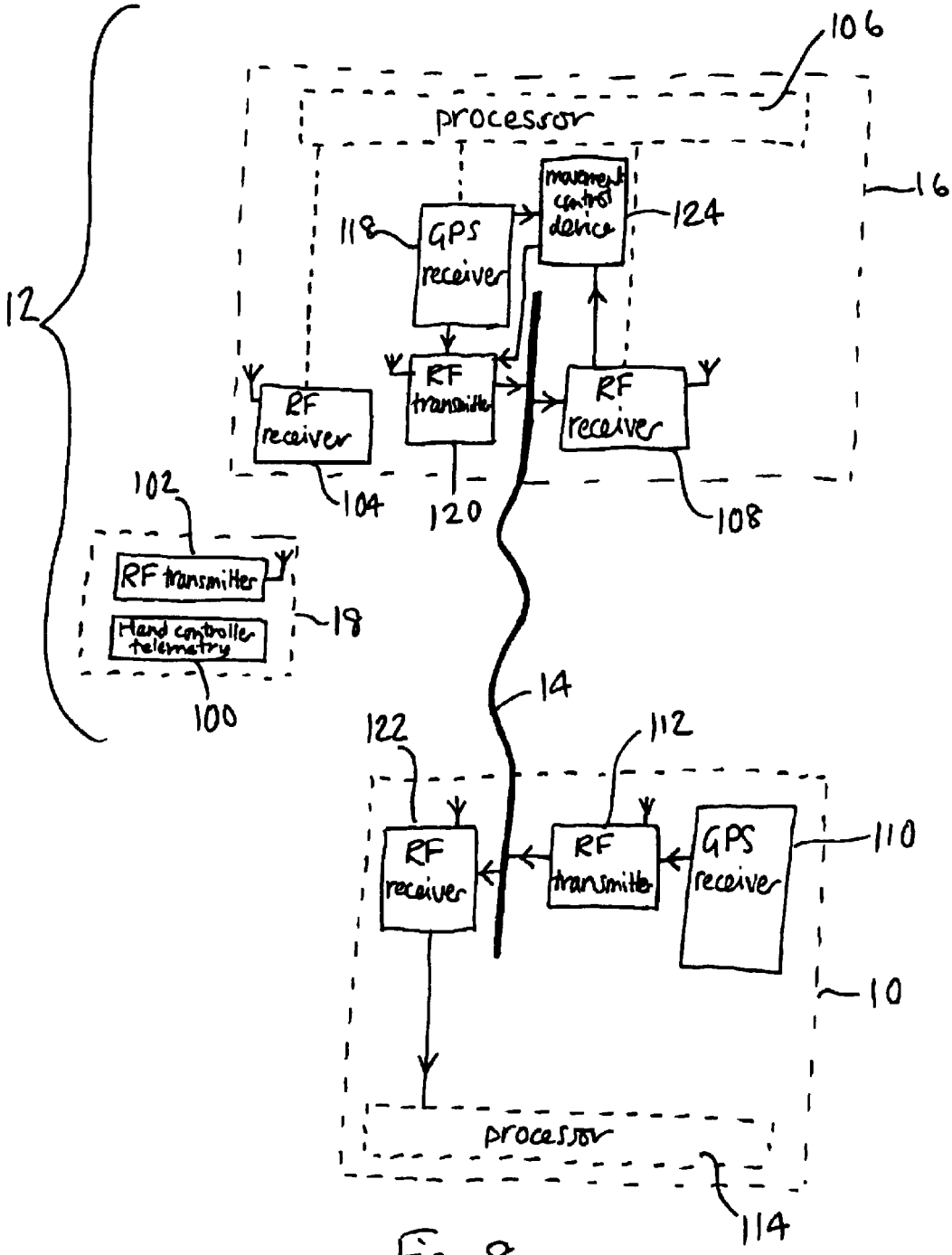
FIG. 8 shows a block diagram of electronic components comprised within a second aspect of the fifth embodiment of the present invention.

FIG. 8 shows an alternative arrangement of these features in which the movement control device 124 is located in the topside 12 instead of in the fish 10. Also, a GPS receiver 118 and an RF transmitter 120 is provided in the topside 12, as described with reference to FIGS. 5 and 6. Additionally, the movement control device 124 can feed commands to the topside RF transmitter 120 for transmission from the topside 12 to the fish 10 either via the umbilical cable 14 or via the wireless link. This permits full control of the movements of the fish 10 to be effected whether or not the cable 14 is connected, both with reference to the relative position of the topside 12 and the fish 10, or the relative position of the fish 12 and a desired location, the position data for which are input to the movement control device 124.

Sixth Embodiment

The provision of an ROV system fish with GPS capabilities is of particular advantage as regards recovery of the fish 10 in the event of some kind of failure. This may be accidental severance of the umbilical cable 14, or deliberate detachment of the entangled cable to avoid further damage. Alternatively, one or more components of the fish 10 may fail. For instance, one or more of the thrusters 36 may break down or be damaged, or the power supply 52 may run down, all of which occurrences would disable the fish and prevent it from being driven to the topside. To deal with situations such as these, the fish is preferably provided with a recovery mechanism which automatically returns it to the surface if a trip cannot be continued.

Figure 9:
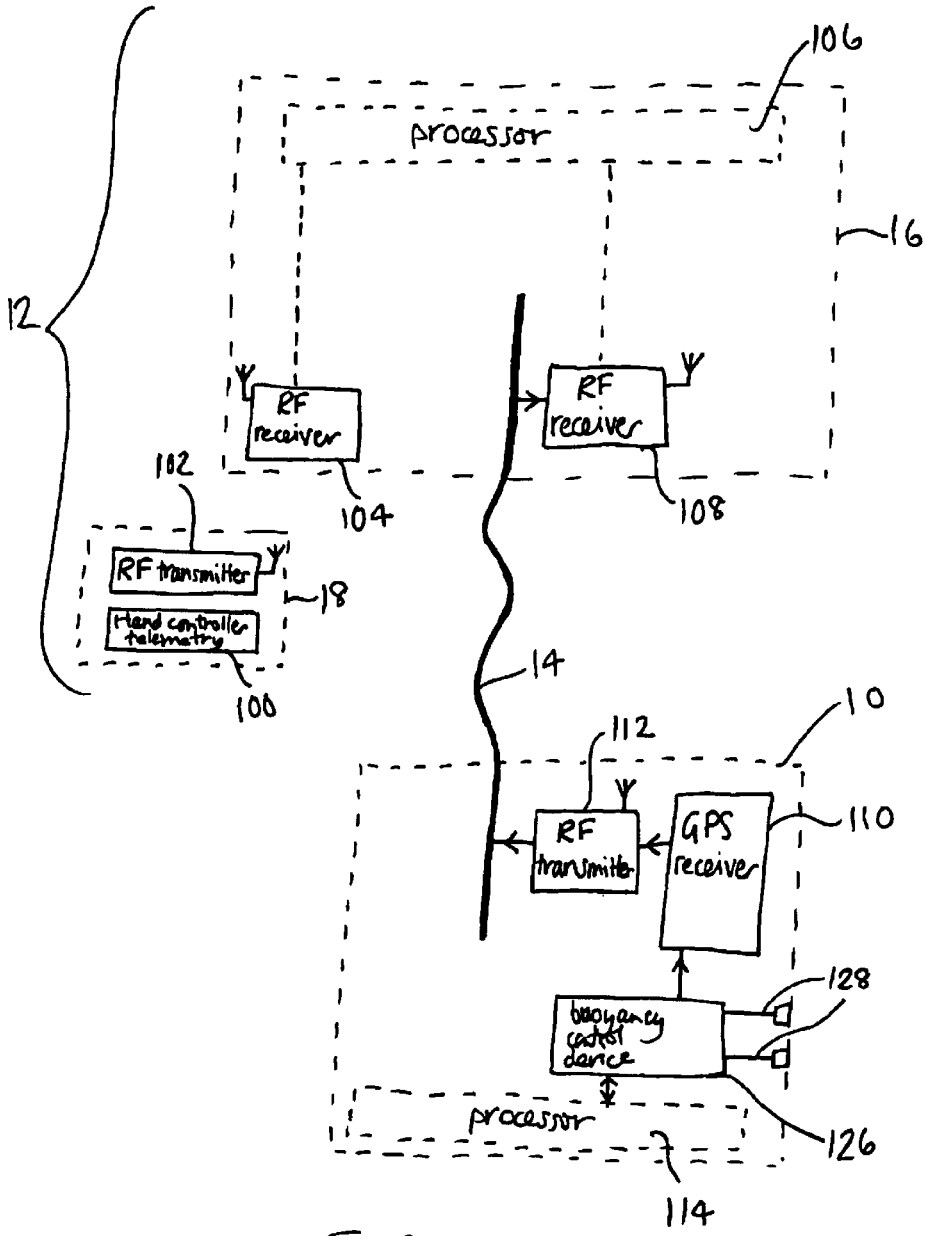
FIG. 9 shows a block diagram of electronic components comprised within a sixth embodiment of the present invention.

FIG. 9 shows a block diagram of a simple embodiment of an ROV system having a recovery mechanism. The fish 10 is equipped with a GPS receiver 110, position data from which can be transmitted to the topside 12, all in accordance with the first embodiment. Additionally, the fish 10 is also provided with a recovery mechanism in the form of a buoyancy control device 126.

Typically, the fish 10 will be configured to be neutrally buoyant at a chosen depth of water, for example 5 m. This allows the fish 10 to stay submerged without the expenditure of battery power to run the vertical thruster which would be required to keep a positively buoyant fish underwater. To bring the fish 10 to the surface from its neutral buoyancy depth, the vertical thruster can be operated, or more emergency-related methods can be employed, such as increasing buoyancy by activating self-inflating floats or dropping ballast weights.

According to the present embodiment, if one of any number of predetermined conditions occurs, such as severance of the umbilical cable 14 or failure of the power supply 52, the buoyancy control device 126 automatically initiates a surfacing routine to bring the fish to the surface. This can involve any of the methods described in the preceding paragraph, or any other suitable way of raising the fish 10. To assist with this, the buoyancy control device 126 can be provided with one or more sensors 128 to detect when the predetermined conditions occur. Once at the surface, the buoyancy control device 126 activates the GPS receiver 110 on the fish 10 to obtain a measurement of the fish's position, and causes the resulting position data to be transmitted to the topside 12. The user can then use this to information to recover the fish 10.

Seventh Embodiment

Figure 10:
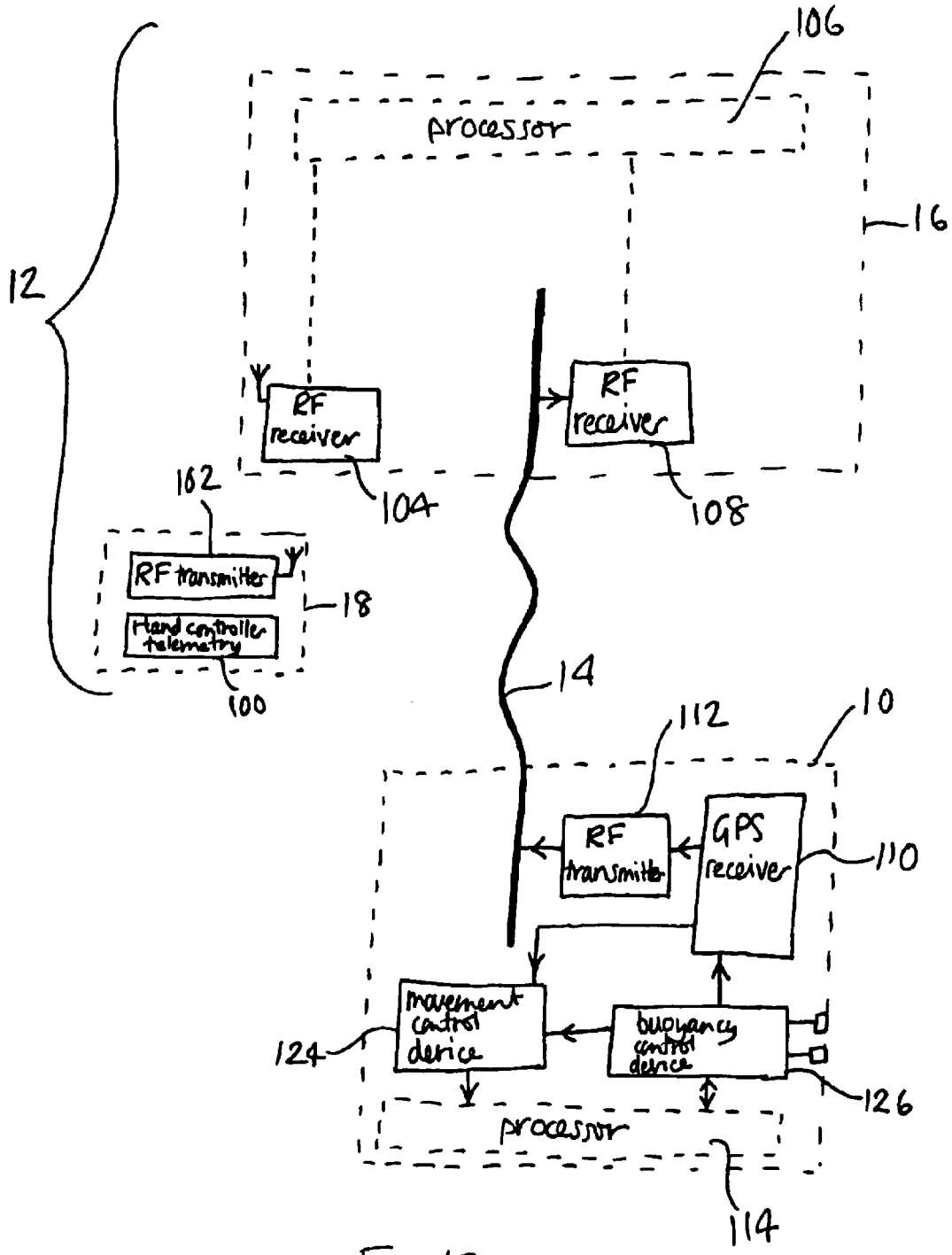
FIG. 10 shows a block diagram of electronic components comprised within a seventh embodiment of the present invention.

FIG. 10 shows a block diagram of a more sophisticated embodiment employing a buoyancy control device 126. In addition to the features shown in FIG. 9, the fish 10 further comprises a movement control device 124 such as that described with reference to FIG. 7. Once the buoyancy control device 126 has brought the fish 10 to the surface in response to a predetermined condition requiring recovery, and has triggered the GPS receiver to measure the fish's position, it also activates the movement control device 124. This receives position data relating to the fish's present position from the GPS receiver 110, and undertakes the processing necessary to produce movement commands to drive the fish 10. For example, if the movement control device 124 is pre-programmed with the position of the topside 12, the fish 10 can be driven back to the topside 12.

In this embodiment, any operation of the movement control device requires that the condition which caused recovery to be necessary is not one which disables movement of the fish 10, such as a damaged thruster. If the fish 10 is not able to propel itself back to the topside 12 or some other location, it can remain stationary, send its position to the topside 12 and await recovery by the user. Additionally, the buoyancy control device 126 can be configured to send a signal to the topside 12 to indicate that the fish is disabled and needs to be recovered, for example, by utilising the fish RF transmitter 112 used to send position data.

Eighth Embodiment

Figure 11:
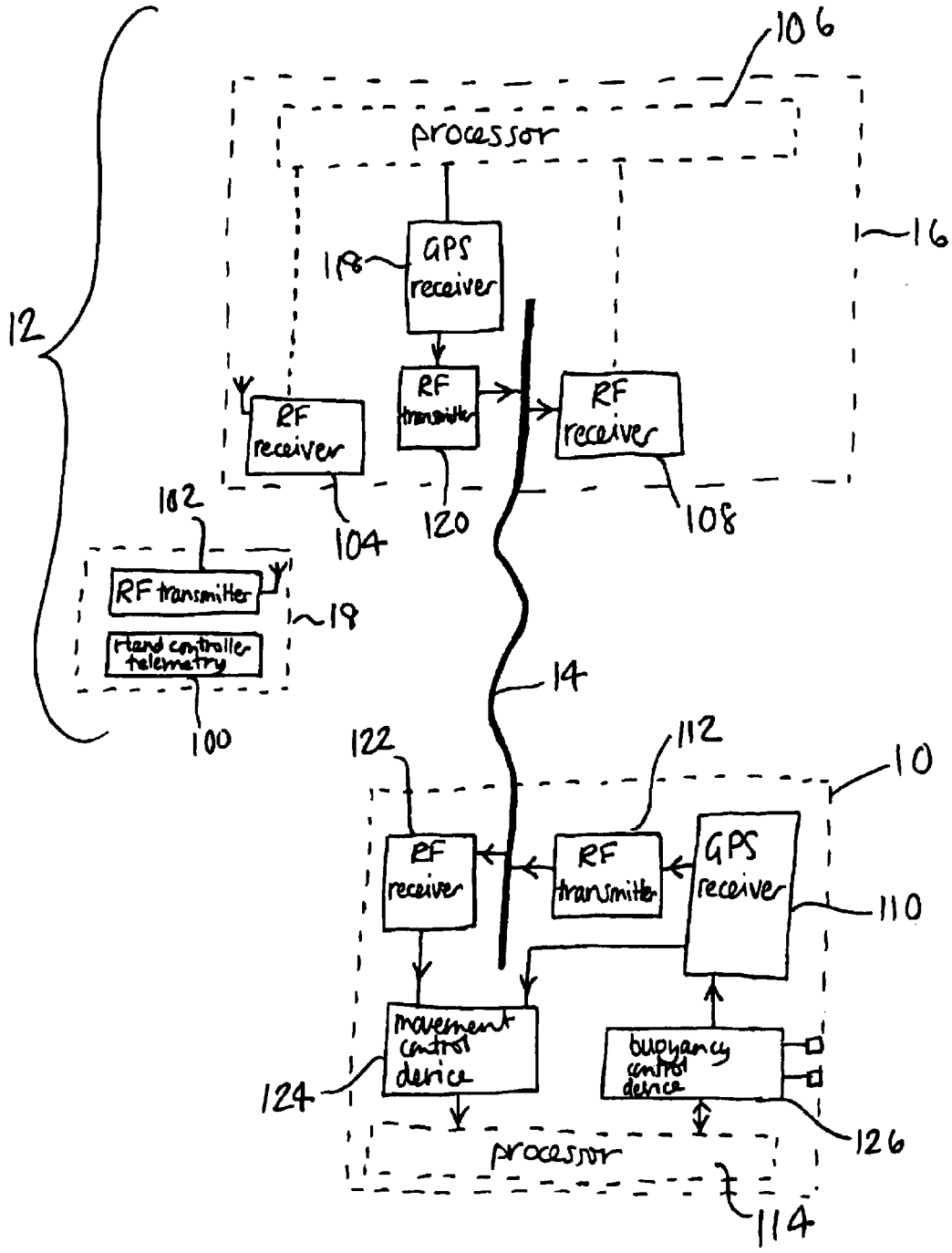
FIG. 11 shows a block diagram of electronic components comprised within an eighth embodiment of the present invention.

FIG. 11 shows a block diagram of a further embodiment incorporating a buoyancy control device 126. In this case, in addition to the features of the previous embodiment, the topside 12 is provided with a GPS receiver 118 and an RF transmitter 120 with a corresponding RF receiver 122 in the fish 10, in accordance with the fourth embodiment. This allows for complete autonomous recovery of the fish 10 in cases when it is able to propel itself, i.e. when there is no fault with the thrusters 36 or power supply 52. In this case, following detection by the buoyancy control device 126 of a predetermined recovery condition, the buoyancy control device 126 activates the steps of bringing the fish 10 to the surface, activating the fish GPS receiver 110 to measure the fish's position, activating the topside GPS receiver 118 (by use of the fish RF transmitter 112 if the cable is not usable) to measure the topside's position and transmit that information to the fish 10, and activating the movement control device 124 to process the two positions to determine the relative position and hence derive appropriate movement commands to drive the fish 10 back to the topside.

Additionally, the ROV system can be configured so that this autonomous recovery procedure can be activated under circumstances other than the above-mentioned circumstances, which may be considered as emergency or disaster circumstances. For example, the topside can be configured to allow the user to enter a recovery command at any time while the fish 10 is deployed. The topside processor 106 conveys this command along the umbilical cable 14 to the fish 10 to activate the buoyancy control device 126, so that the fish 10 is returned quickly and simply to the topside 12 with no effort required from the user. Under these circumstances, it is desirable if the buoyancy control device 126 raises the fish by using the vertical thruster rather than by, for example, dropping ballast, which will then have to be replaced. Also, the fish 10 or the topside 12 can include a clock device which controls the buoyancy control device and activates it after a certain pre-set length of time has elapsed since the launch of the fish 10. The length of time can be chosen, for example, to ensure that the fish 10 automatically returns before the power supply 52 runs down, to avoid the user having to go out to recover the fish 10. Similarly, the buoyancy control device 126 can be configured to monitor the charge remaining in the power supply 52 so that it can automatically return the fish 10 to the topside 12 before the charge is used up and the fish 10 is left stranded.

Ninth Embodiment

All the above-mentioned embodiments have permitted transmission of GPS measurements from the fish 10 to the topside 12, which allows, among other applications, the user to keep track of the fish's position. Some embodiments have included two-way communication, in which GPS measurements of the topside's position could also be transmitted to the fish 10.

Useful results can also be achieved by providing a one-way communication between the topside 12 and the fish 10, in which GPS measurements of the topside's position can be communicated to the fish 10, but not vice versa.

Figure 12:
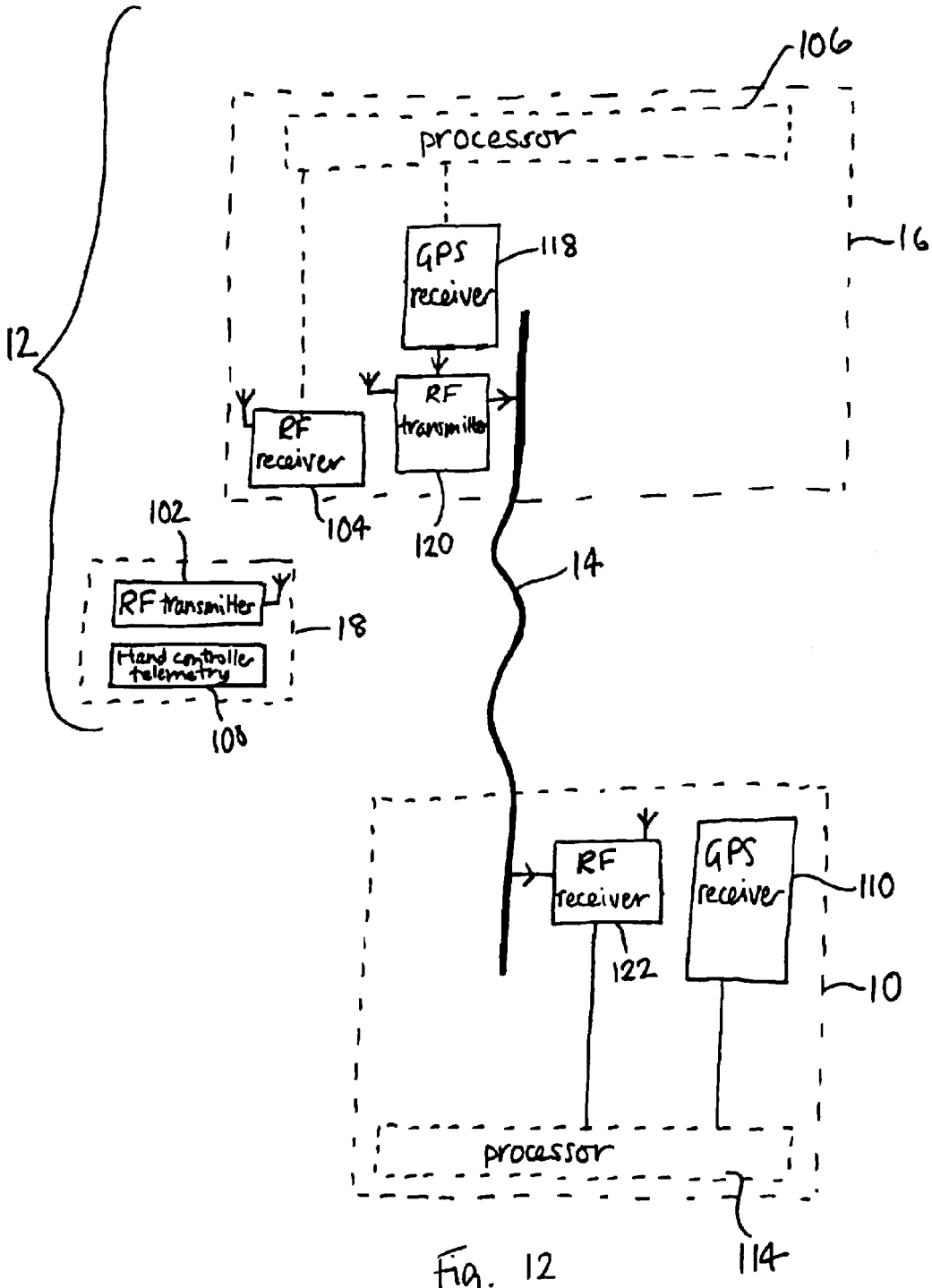
FIG. 12 shows a block diagram of electronic components comprised within a ninth embodiment of the present invention.

FIG. 12 is a block diagram of an embodiment having this feature. In common with previous embodiment, the fish 10 has a GPS receiver 110. However, it does not have an RF transmitter to transmit position data relating to the fish 10 to the topside 12 for processing. Instead, it comprises an RF receiver 122, which is operable to receive (via the umbilical cord 14 or the wireless link) GPS position data obtained from a GPS receiver 118 in the topside 12 and transmitted from an RF transmitter 120 in the topside 12.

This configuration can be used to permit the fish to drive itself back to the topside. Following a command from the user, or the initiation of an autonomous recovery procedure as described above, the fish 10 measures its own GPS position using its GPS receiver 110, the topside 12 measures its GPS position using its GPS receiver 118 and transmits the resulting position data to the fish 10, and then the fish 10, either in its processor 114 or a defined movement control device (not shown) determines its position relative to the topside 12 and uses this information to steer itself back to the topside 12.

Thus, this embodiment has similar functionality to many of the other embodiments. It does not, however, permit the fish's position to be monitored, tracked or processed at the topside, but in many instances this will not be significant as knowledge of the fish's position by any element other than the fish is not required for the fish to be able to be automatically returned to the topside.

Further Embodiments

An ROV system equipped with GPS capabilities in accordance with the present invention may also beneficially make use of the known properties of GPS receivers. For example, the so-called "back-tracking" facility can be used. A fish travelling following a route along the surface of the water towards a destination periodically takes a GPS reading. The resulting position data is logged, either in the GPS receiver, in the fish processor, or transmitted back for storage in the topside processor. When the fish is to return to the topside, these data are used to navigate the route in reverse, thus bringing the fish safely back to the topside. This is of use in circumstances where there is no direct surface route from the topside to a desired destination, so that the fish is deployed by being steered along a circuitous route by the user. Calculation of the relative position of the fish and the topside will not then provide enough information for the fish to be returned automatically, because the calculation will not necessarily take account of any intervening obstacles.

Furthermore, the fish may also be equipped with an inertial guidance system. GPS cannot be used underwater, so that a fish navigating by GPS must travel along the surface of the water, or must periodically surface to obtain a measurement of its position. This is satisfactory for many applications, but can be enhanced by using an INS. These systems can operate underwater, and calculate the position of the fish relative to its starting point, typically the topside, by monitoring its movements. However, errors tend to arise, owing to the underwater forces to which the fish is subject. This can be corrected if the fish periodically surfaces and obtains a GPS measurement of its absolute position. This can be compared with the current position calculated by the INS, and if an error is found, the GPS reading can be used to correct the INS calculation. Thus the benefits of underwater navigation by INS are combined with the benefits of the highly accurate positioning and locating achievable by using GPS.

Use of the GPS System

Although some aspects and embodiments of the present invention are intended to operate automatically in response to particular circumstances, there are many cases in which input from a user is required or desirable. This may be provided by way of a keypad or keyboard associated with the computer unit 18 of the topside 12. Most conveniently, however, the user is able to operate the GPS features via the handset 16.

Figure 13:
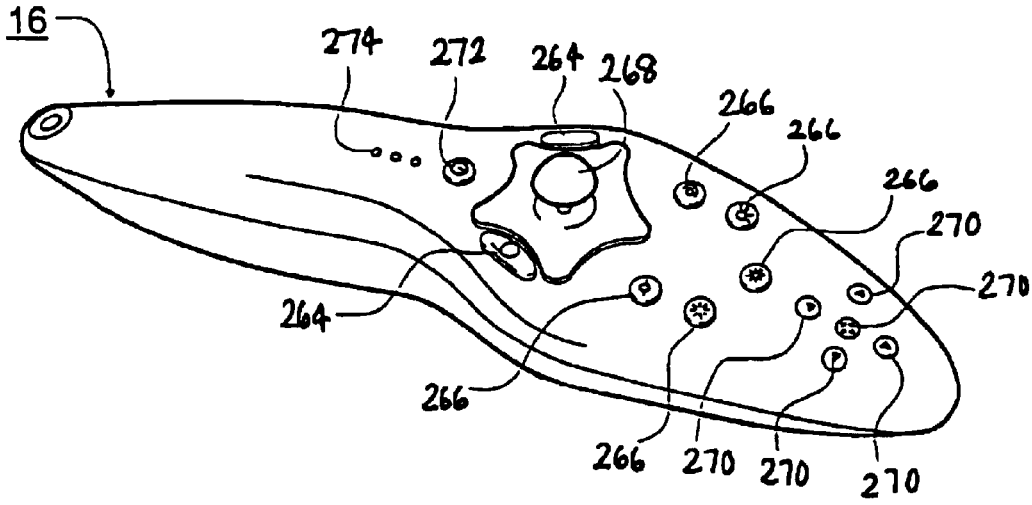
FIG. 13 shows a perspective view of a handset used to communicate with the topside of FIG. 1.

FIG. 13 is a perspective view of an example handset 16. The handset 16 is ergonomically designed to be conveniently and comfortably operated by a user holding the handset 16 in one hand. The handset 16 includes on its upper surface a joystick 268 used to steer the fish, and buttons of various types 264, 266, 270, 272 and 274 used to convey particular commands. Buttons additional to those illustrated can be included as desired, and other data input devices can be further included, such as a touch-sensitive screen.

To operate the GPS features, the handset can include buttons dedicated to particular GPS functions, such as activating the recovery procedure, or obtaining a GPS position measurement from the fish. Alternatively, a single button or a menu option on a screen can be provided which puts the handset into a "GPS" mode, in which some or all of the controls temporarily have particular GPS functions. A data input device capable to handling GPS position data, such as an alphanumeric input device, is also preferably provided (either on the handset or the computer unit) to permit entry of the position of target sights or of the topside, so that the fish can navigate automatically.

It is to be understood that the various features described above with reference to particular embodiments can be combined in ways other than those illustrated to produce additional embodiments which still fall within the contemplated scope of the invention. It will be appreciated that although particular embodiments of the invention have been described, many modifications/additions and/or substitutions may be made within the spirit and scope of the present invention.

What is claimed is:

1. An ROV system comprising:

a topside;

a fish fitted with a GPS receiver;

a position data transmitter operable to transmit GPS position data;

a position data receiver operable to receive GPS position data; and an umbilical cable for interconnecting the fish and the topside, and having a communication path for relaying the GPS position data between the topside and the fish;

wherein the umbilical cable comprises a connector operable to detachably connect it to the fish, and which can be remotely operated by a detach command sent from the topside which causes the cable to detach from the fish;

and further comprising a tension sensor operable to measure tension in the umbilical cord and to cause a detach command to be sent to the connector if the tension exceeds a predetermined level.

2. An ROV system comprising:

a topside;

a fish fitted with a GPS receiver;

a position data transmitter operable to transmit GPS position data; and a position data receiver operable to receive GPS position data;

the position data transmitter and the position data receiver being further operable to relay GPS position data between the topside and the fish; and wherein the fish further comprises a buoyancy control device operable to automatically surface the fish from a depth of water in response to one or more predetermined conditions.

3. An ROV system according to claim 2, wherein:

the fish includes the position data transmitter, the position data transmitter being operable to transmit GPS position data obtained from the GPS receiver; and the topside includes the position data receiver, the position data receiver being operable to receive the GPS position data transmitted from the fish.

4. An ROV system according to claim 2, wherein:

the topside is fitted with a GPS receiver, and includes the position data transmitter, the position data transmitter being operable to transmit GPS position data obtained from the topside GPS receiver; and the fish includes the position data receiver, the position data receiver being operable to receive GPS position data transmitted from the topside.

5. An ROV system according to claim 2, wherein:

the topside includes the position data transmitter, the position data transmitter being operable to transmit predetermined GPS position data; and the fish includes the position data receiver, the position data receiver being operable to receive predetermined GPS position data from the topside.

6. An ROV system according to claim 5, wherein the topside comprises a GPS position data input device for user input of predetermined GPS position data.

7. An ROV system according to claim 6, and further comprising a movement control device operable to process the predetermined GPS position data and GPS position data obtained from the GPS receiver, and control movement of the fish in response to results of the processing.

8. An ROV system according to claim 2, wherein the fish has an onboard power supply.

9. An ROV system according to claim 2, wherein the fish comprises an upwardly protruding portion which houses the GPS receiver aerial.

10. An ROV system according to claim 2, further comprising an umbilical cable for interconnecting the fish and the topside, and having a communication path for relaying the GPS position data.

11. An ROV system according to claim 10, wherein the one or more predetermined conditions include one or more of: severance of the umbilical cable; detachment of the umbilical cable from the fish; failure of a power supply operable to power the fish; and failure of thrusters operable to propel the fish.

12. An ROV system according to claim 2, wherein the GPS position data is transmitted via air.

13. An ROV system according to claim 2, wherein the topside further comprises a GPS receiver.

14. An ROV system according to claim 13, wherein the topside further comprises a second position data transmitter operable to transmit GPS position data obtained from the GPS receiver on the topside from the topside to the fish, and the fish further comprises a second position data receiver operable to receive GPS position data transmitted from the topside.

15. An ROV system according to claim 2, and further comprising a movement control device operable to process GPS position data and control movement of the fish in response to results of the processing.

16. An ROV system according to claim 15, wherein the movement control device is located in the fish.

17. An ROV system according to claim 15, wherein the movement control device is located in the topside.

18. An ROV system according to claim 15, wherein the movement control device is operable to process GPS position data obtained from the GPS receiver on the fish during earlier movements and control subsequent movement of the fish in response to results of the processing.

19. An ROV system according to claim 2, wherein the fish includes the position data transmitter, and the buoyancy control device is further operable to activate the GPS receiver and the position data transmitter when the fish surfaces.

20. An ROV system according to claim 19, wherein the fish further comprises a movement control device operable to process GPS position data obtained from the activated GPS receiver and control movement of the fish in response to the results of the processing so as to propel the fish toward the topside.

21. An ROV system according to claim 20 wherein the movement control device is further operable to process GPS position data received from a GPS receiver on the topside.

22. A method of navigating a fish associated with an ROV system, comprising:

providing the fish with an inertial navigation system and a GPS receiver;

propelling the fish underwater from a starting position;

monitoring movement of the fish with the inertial navigation system to calculate its position relative to the starting position;

periodically surfacing the fish and activating the GPS receiver to obtain a measurement of absolute position of the fish;

comparing the measured absolute position and the calculated relative position to determine any error in the calculated relative position; and correcting the calculated relative position to correspond to the measured absolute position if an error is found.

23. An ROV system comprising:

a topside;

a fish fitted with a GPS receiver;

a position data transmitter operable to transmit GPS position data; and a position data receiver operable to receive GPS position data;

the position data transmitter and the position data receiver being further operable to relay GPS position data between the topside and the fish; and further comprising an inertial navigation system on the fish operable to monitor movement of the fish and calculate its position relative to a starting position.

24. A method of recovering a fish associated with an ROV system, comprising:

surfacing the fish from a depth of water;

activating a GPS receiver on the fish to obtain first GPS position data relating to the absolute position of the fish;

activating a GPS receiver on a topside to obtain second GPS position data relating to the absolute position of the topside;

comparing the first and second GPS position data to determine the relative position of the fish and the topside;

providing third GPS position data relating to the relative position to a movement control device operable to control propulsion of the fish; and controlling propulsion of the fish in response to the third GPS position data to bring the fish adjacent to the topside.

25. A method according to claim 24, wherein the fish is automatically surfaced from a depth of water in response to severance or detachment of an umbilical cable interconnecting the fish and the topside.

26. A method according to claim 24, wherein the comparison of the first and second GPS position data comprises sending GPS position data between the fish and the topside by radio frequency communication.

27. A method of navigating a fish associated with an ROV system, comprising:

determining a route along which the fish will navigate;

determining a plurality of GPS position data, each datum corresponding to a location on the route;

providing the GPS position data to a topside of the ROV system;

transmitting the GPS position data from the topside to the fish; and activating a movement control device on the fish operable to propel the fish from location to location in response to the GPS position data and periodic measurements of actual fish location obtained from a GPS receiver on the fish.

* * * * *